United States Patent [19]

Auer et al.

[11] 4,154,457

[45] May 15, 1979

[54] SKI WITH WEIGHT ATTACHMENT

[75] Inventors: Peter Auer; Adolf Hetzer, both of Heufeld, Fed. Rep. of Germany

[73] Assignee: Fritzmeier AG, Lenzburg, Switzerland

[21] Appl. No.: 784,824

[22] Filed: Apr. 5, 1977

[30] Foreign Application Priority Data

Mar. 4, 1977 [DE] Fed. Rep. of Germany ..... 2709517

[51] Int. Cl.[2] ..... A63C 5/06

[52] U.S. Cl. ..... 280/601; 280/11.37 E

[58] Field of Search ..... 280/602, 601, 11.37 E

[56] References Cited

U.S. PATENT DOCUMENTS

| | | | |
|---|---|---|---|
| 2,756,063 | 7/1956 | Mercier | 280/11.37 G |
| 3,031,697 | 5/1962 | Klein | 280/11.37 E |
| 3,747,947 | 7/1973 | Gunzel | 280/602 |
| 4,018,454 | 4/1977 | Burkart | 280/602 |

FOREIGN PATENT DOCUMENTS

| | | | |
|---|---|---|---|
| 1428966 | 1/1963 | Fed. Rep. of Germany | 280/602 |
| 1908157 | 1/1965 | Fed. Rep. of Germany | 280/602 |
| 1478110 | 9/1969 | Fed. Rep. of Germany | 280/602 |
| 1960684 | 6/1970 | Fed. Rep. of Germany | 280/602 |
| 2052332 | 4/1972 | Fed. Rep. of Germany | 280/602 |
| 2227017 | 12/1973 | Fed. Rep. of Germany | 280/602 |
| 2502031 | 7/1976 | Fed. Rep. of Germany | 280/602 |
| 558185 | 1/1975 | Switzerland | 280/601 |

*Primary Examiner*—David M. Mitchell

*Attorney, Agent, or Firm*—Oblon, Fisher, Spivak, McClelland & Maier

[57] ABSTRACT

A ski having extra weights stationarily disposed adjacent the longitudinal ends thereof and being interchangeably and detachably fixed in their respective positions. A base plate is secured to the ski, the extra weight set thereon, and a covering weight head is secured over the extra weight to the base plate through an anchoring bolt.

7 Claims, 1 Drawing Figure

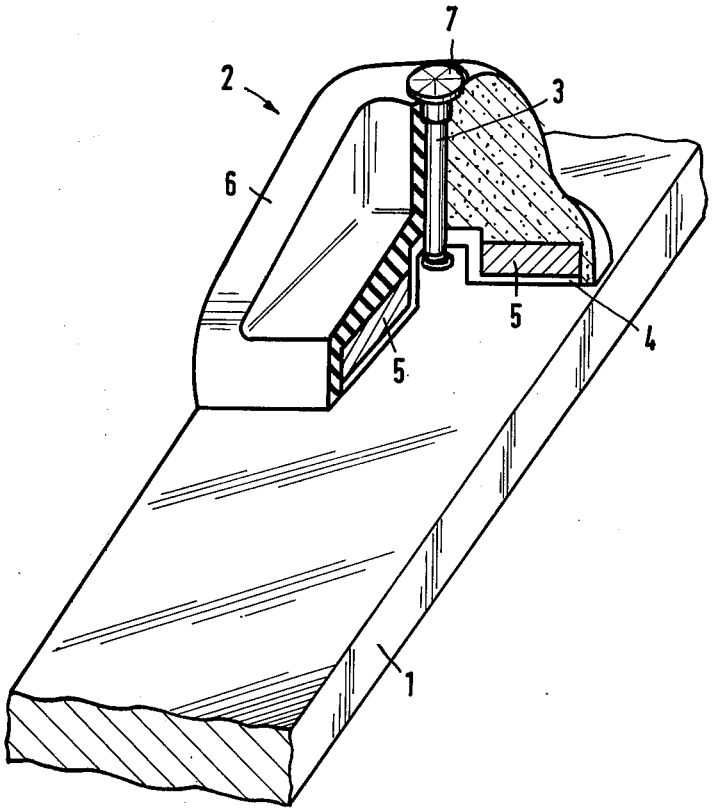
7
2
3
6
5
4
5
1

SKI WITH WEIGHT ATTACHMENT

BACKGROUND OF THE INVENTION

1. Field of the Invention

The present invention relates to a ski with a variable inertia moment. More specifically, since the behavior of a ski in motion depends, among other things, essentially on the inertia moment which the ski opposes to a change in the direction of movement, the present invention provides a ski with which it is possible, when desired or necessary, to adapt the inertia moment thereof to the given circumstances.

2. Description of the Prior Art

From DT-PS West German Pat. No. 2,052,332 to Ernst Werner Gunzel, filed Oct. 24, 1970 and published Jan. 29, 1976, a ski is known on which weights disposed on or inside the rear or front part thereof can be moved in the longitudinal direction of the ski, and fixed, to change its inertia moment. By altering the distance of the weights from either end of the ski, its inertia moment is changed around both a vertical or rotation axis of the ski and a horizontal axis oblique to the longitudinal direction of the ski. The inertia moment around the vertical or rotation axis influences the "rotation behavior" of the ski. Thus, a ski with a small inertia moment, e.g., a short ski or a ski especially light at the ends, can be rotated more easily than a ski with a large inertia moment. An easily rotated ski is especially suitable for particular snow conditions such as deep or heavy snow, terrain conditions, such as a bumpy run, and skiing abilities such as, beginners or in trick skiing, A ski with a large inertia moment, that is a long ski or a ski with relatively large weights at the ends, has exceptional directional stability during fast downhill runs because the forces exerted horizontally on the ski by the inequalities of the slope, especially on traversing laterally, are "swallowed" better because of the larger inertia moment of the ski.

The inertia moment around an axis oblique to the longitudinal direction of the ski determines the elastic properties of the front or rear part of the ski at any given time. When travelling rapidly, vertical changes in direction are conveyed to the ski, especially the front part, by the inequalities of the slope. A greater weight at this point on the ski effects a greater smoothness of running and prevents "wobbling". In this way, better holding of the ground by the ski edges and thus good directional stability are obtained.

However, the practical execution of this system was very difficult and expensive. The arrangement of the weights inside the ski unfavorably weakened the cross-section of the ski and required the construction of completely new skis with hollow cross sections and adjustment mechanisms. With the weights arranged on the surface of the ski, the functioning of the adjustment mechanism is liable to be impaired by deposits of snow and ice and other mechanical influences such as occur, for example, when the skis are crossed or on falling. The fact that the weights and thus the weight of the ski remain the same when the inertia moment is decreased, by shifting the weights in the direction of the middle of the ski, is also disadvantageous.

SUMMARY OF THE INVENTION

An object of the present invention therefore is to provide a constructionally simple and inexpensive ski with which it is possible to influence the inertia moment thereof without shifting the weights.

This and other objects are achieved by mounting fixed extra weights on the ends of the ski.

With the present invention, a relatively short ski is achieved which preserves the running properties of a long ski, i.e., the above-mentioned positive properties of the short ski, or compact ski, and the positive properties of the long ski, or the downhill ski, which were also explained, are united in one ski, with the respective negative properties being eliminated. The "length" of the ski can be determined beforehand by selecting the appropriate extra weights.

In this case, the extra weights can be secured by the manufacturer inside or on the upper surface of the ski, whereby a relatively short ski thus obtains the inertia moment of a ski with a very definite "length".

It is also possible for extra weights of definite size to be mounted at the time of purchase of the skis, according to the choice or desire of the purchaser. The possibility is thus given of mounting other extra weights at a later time and, in this way, thus permitting changing the "length" of the ski, e.g., on reselling the skis or for adaptation to skiing ability.

A third possibility envisages variable extra weights which are composed of weight insets. By exchanging the weight insets for other insets with greater or lesser weight, the inertia moment can be changed at any time without great expense, with a few manipulations, so that the skier can adapt the "length" of his ski to the given conditions on the spot. Depending on the choice of the size of the extra weights on the front and rear part of the ski, the vertical axis of rotation of the ski can be shifted in the longitudinal direction, so that different skiing techniques, as fore position or back position, become possible and are assisted.

BRIEF DESCRIPTION OF THE DRAWING

Other objects, features and attendant advantages of the present invention will be more fully appreciated as the same becomes better understood from the following detailed description when considered in connection with the accompanying drawing, wherein the sole FIGURE is a perspective view, partly in section, of a front part of a ski constructed according to the present invention.

DETAILED DESCRIPTION OF THE PREFERRED EMBODIMENT

In the sole FIGURE is shown a ski 1 and an extra weight 2 on the front part thereof.

A base plate 4 is mounted on the surface of the ski by gluing, screws, or other suitable fastening means. An anchor bolt 3 is anchored in the base plate 4, the former reaching behind a bore in the base plate through an expansion of its axis, a cross pin or a similar constructional component which has a greater diameter than the bolt. A weight head 6 covers or overlaps a weight inset 5, which is set on the base plate 4. A slotted bolt heat 7 of the anchor bolt 3 passes through the weight head 6 and is accessible from above. If a coin, for example, is brought into contact with the slotted portion of the bolt head and turned through a definite angle, the weight head 6 can be removed and the weight inset 5 replaced with a smaller or larger one. Then the weight head is inserted over the new weight inset and base plate and the anchor bolt is again secured by turning the coin, so that there is again a complete and assembled weight unit.

With extra weights of different sizes for the front and rear part of the ski, respectively, the weight insets can be so formed that the inset for the front part of the ski is noninterchangeable with the inset for the rear part of the ski, so that the axis of rotation of the ski is always maintained.

Not depicted is a weight for the rear part of the ski, which may have a different external form from the weight for the front part, but for which the same principles of construction and function prevail.

Obviously, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A ski having a variable inertia moment which comprises:

a ski body including a vertical axis of rotation through the center of gravity of said ski body;

weight means for shifting said vertical axis of rotation of said ski body disposed adjacent both longitudinal ends of said ski body wherein said weight means includes a first and second weight member and a weight head covering each of said first and second weight members; and means for fastening said weight means for shifting said vertical axis of rotation of said ski body and for holding the components of said weight means together as a unit, to an upper surface of said ski body.

2. A ski as set forth in claim 1, wherein:

said weight means for shifting the vertical axis comprises means for longitudinally shifting the vertical axis of rotation of said ski body.

3. A ski having a variable inertia moment which comprises:

a ski body including a vertical axis of rotation through the center of gravity of said ski body;

weight means for shifting said vertical axis of rotation and for changing inertia moment of said ski body disposed adjacent both longitudinal ends of said ski body wherein said weight means includes a first and second weight member and a weight head covering each of said first and second weight members; and means for fastening said weight means for shifting said vertical axis of rotation and for changing inertia moment of said ski body to an upper surface of said ski body and for holding the components of said weight members together as a unit.

4. A ski as set forth in claim 3, wherein:

said weight means for shifting said vertical axis of rotation and for changing inertia moment of said ski body comprises means for longitudinally shifting the vertical axis of rotation of said ski body.

5. A ski having a variable inertia moment which comprises:

weight members disposed adjacent both longitudinal ends of the ski; and, means for fastening said weight members to an upper surface of said ski;

wherein said weight members each comprise a base plate secured to said upper surface of said ski, a weight inset disposed on said base plate, a weight head covering said weight inset on said base plate, and an anchor bolt anchored within said base plate and passing through said weight head which holds the components of the weight members together as a unit.

6. A ski as set forth in claim 5, wherein said weight inset of the front part of the ski which cooperates with the cross-sectional form of the base plate upon which it is disposed includes a different cross-section form than the weight inset of the rear part of the ski which cooperates with the cross-sectional form of the base plate upon which it is disposed so as to be non-interchangeable.

7. A ski as set forth in claim 5, wherein said anchor bolt includes a head having slots thereon for allowing ready turning thereof by a suitable edge surface of a turning member.

* * * * *